US006439146B2

(12) United States Patent
Seaman et al.

(10) Patent No.: US 6,439,146 B2
(45) Date of Patent: Aug. 27, 2002

(54) MOORING TUBE ASSEMBLY WITH SWIVEL MOUNTED CHAIN SUPPORT

(75) Inventors: David M. Seaman, Hockley; Humphrey C. Han, Houston; Martin J. Krafft, Houston; William L. Fontenot, Houston, all of TX (US)

(73) Assignee: FMC Technologies, Inc., Chicago, IL (US)

( * ) Notice: Subject to any disclaimer, the term of this patent is extended or adjusted under 35 U.S.C. 154(b) by 0 days.

(21) Appl. No.: 09/756,499

(22) Filed: Jan. 9, 2001

Related U.S. Application Data

(60) Provisional application No. 60/175,144, filed on Jan. 7, 2000.

(51) Int. Cl.[7] ..... B63B 21/00
(52) U.S. Cl. ..... 114/230.12; 114/200
(58) Field of Search ..... 254/389; 114/293, 114/230.1, 230.12, 199, 200

(56) References Cited

U.S. PATENT DOCUMENTS 4,305,341 A 12/1981 Stafford
4,742,993 A * 5/1988 Montgomery et al. ..... 254/389
5,845,893 A 12/1998 Groves
5,937,780 A 8/1999 Etheridge et al.

FOREIGN PATENT DOCUMENTS

GB 1194371 6/1970

* cited by examiner

*Primary Examiner*—Ed Swinehart
(74) *Attorney, Agent, or Firm*—Gary L. Bush, Esq; Andrews & Kurth, LLP.

(57) ABSTRACT

A vessel with a mooring tube assembly with swivel mounted chain supports. The assembly includes a frame arranged and designed for support within a vertical opening of the vessel at its bow and/or its stern. A plurality of chain tubes are carried on the outer side of the frame in an arc such that their top ends extend upwardly generally parallel to the vertical axis of opening of the vessel. The vessel includes a deck mounted above the upper end of the frame. A track on the deck allows a single winch to be moved so that a pull-in line can be registered with any of the top ends of the tubes. A plurality of chain supports are rotationally mounted on the frame where each chain support has an outlet and an inlet. A trunnion chain stopper is provided between the outlet and inlet of the chain support. The outlet of each chain stopper is in registration with the lower end of one of the chain tubes.

10 Claims, 6 Drawing Sheets

FIG. 8C
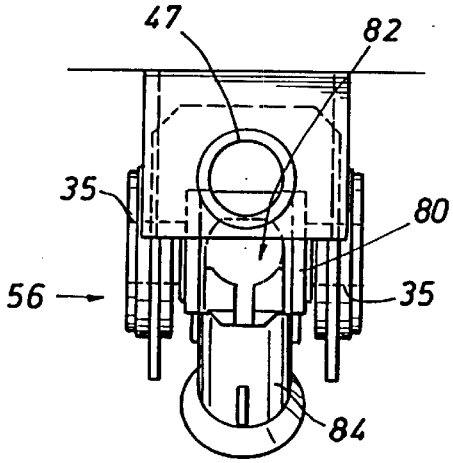
FIG. 8A
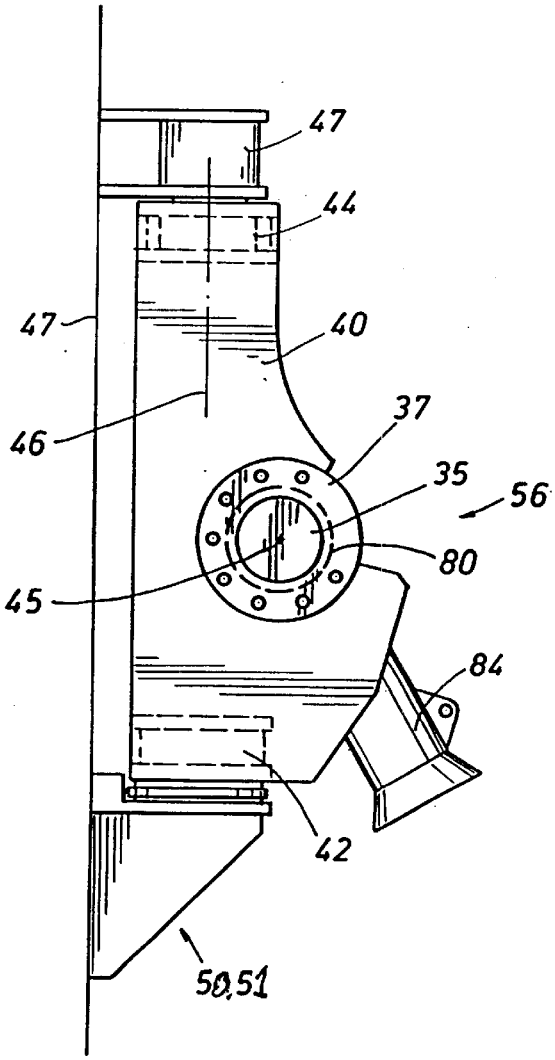
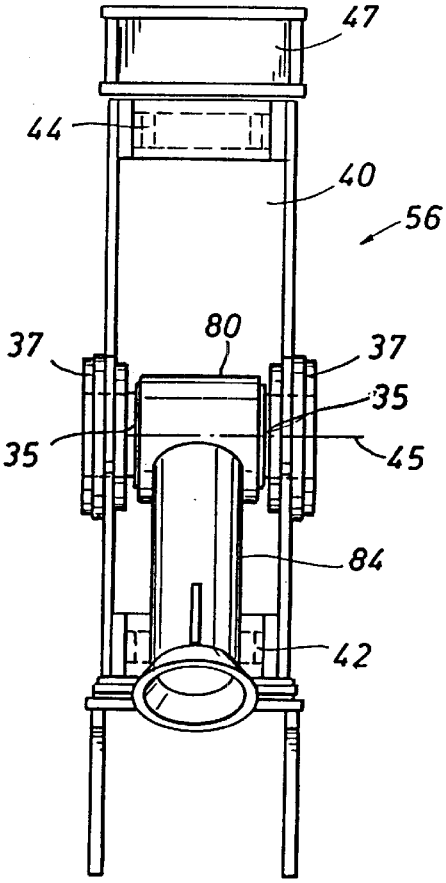
FIG. 8B

MOORING TUBE ASSEMBLY WITH SWIVEL MOUNTED CHAIN SUPPORT

CROSS REFERENCE TO RELATED APPLICATION

This non-provisional application claims priority from provisional application 60/175,144 filed on Jan. 7, 2000.

BACKGROUND OF THE INVENTION

1. Field of the Invention

This invention relates in general to mooring equipment for vessels and in particular to chain support equipment for mooring legs of a spread mooring arrangement for a permanently moored storage vessel.

2. Description of the Prior Art

FIGS. 1 and 2 illustrate a prior art spread mooring system of British Patent 1,194,371 (published Jun. 10, 1970) having mooring legs 10 at the bow and stem of the vessel 20. FIG. 1 is a plan view of a storage vessel with two shuttle oil-tankers 22 berthed along side of it. FIG. 2 is a view similar to that of FIG. 1, but showing the storage vessel alone, skewed to port so that it can be pointed toward wind, waves, or current. The mooring legs must be lengthened and shortened appropriately to accommodate this rotation of the storage vessel from the position of FIG. 1 to that of FIG. 2.

FIGS. 3, 4, and 5 illustrate a prior art spread mooring system where anchor legs 10 at the bow and stern of a storage vessel extend from the sea floor through an opening in the bottom of the hull and pass through mooring insert tubes 120, one at the bow and the other at the stern of the vessel. The anchor legs of FIGS. 3, 4, and 5 cannot easily be lengthened/shortened to provide a skewed orientation of a vessel like that of FIGS. 1 and 2.

Other prior chain supports have included many moving parts and components which are prone to failure over time such as spring loaded flappers. Other prior chain support systems are deck mounted which require hull stiffening to transfer mooring loads. Such prior configurations require multiple sheaves, portable sheaves or vertical capstans which require a huge expanse of deck to reach all anchor legs from a central point.

IDENTIFICATION OF OBJECTS OF THE INVENTION

A primary object of this invention is to provide a spread mooring arrangement where anchor legs enter the bottom of a vessel and extend upwardly through mooring insert tubes, one for each anchor chain, but can easily be lengthened or shortened to provide skewed headings of the vessel depending on wave, wind and current conditions.

Another object of the invention is to provide a trunnion style chain stopper into a swivel mounted chain support.

Another object of this invention is to provide a fixed self-contained modular unit for installation in a vessel for swivel chain support mounting.

Another object of this invention is to provide a self-contained modular unit which is arranged and designed for installation within the hull of a vessel, below decks, so as to avoid interference with deck houses, hose hauling and/or process equipment.

Another object of this invention is to provide a unit having a single installation winch at the stern, another at the bow, which can be moved among a plurality of anchor leg stations respectively at the stern and bow, to serve all anchor legs.

Another object of this invention is to provide a swivel mounted chain support where an anchor chain is pulled in and slides against a single trunnion guide face.

Another object of this invention is to provide a swivel mounted chain support with a single trunnion guide face where mooring loads between anchor chains and the vessel are transferred at the head of the trunnion support.

Another object of this invention is to provide a chain stopper in a single trunnion guide on a hull mounted chain support, rather than a deck mounted chain stopper, thereby providing a chain guidance to assume alignment in the lateral direction with the flapper of the chain stopper.

SUMMARY OF THE INVENTION

The objects identified above, along with other features and advantages result from providing a swivel mounted chain support, one for each anchor leg, at the bottom end of a mooring insert tube, so that as the vessel changes its heading, each anchor leg has its chain support turned to directly face its respective anchor leg, rather than entering the chain support at an angle. The mooring insert tube assembly, one for the bow, the other for the stern, is a fixed self-contained modular unit installed at the bow or stern of a vessel and includes one or more mooring insert tubes. A trunnion style chain stopper is mounted in a swiveling base to allow for rotation about a vertical axis similar to a standard fairlead sheave. A single winch is installed above the insert tube assembly with tracks to permit the winch to be moved from alignment with one mooring insert tube to another.

BRIEF DESCRIPTION OF THE DRAWINGS

FIGS. 8A, 8B, 8C present a more detailed illustration, (with side, front and top views) of the mounting of the trunnion chain stopper in a swiveling base for partial rotation about a vertical axis and partial rotation about a horizontal axis;

DESCRIPTION OF PREFERRED EMBODIMENT OF THE INVENTION

Figure 1:
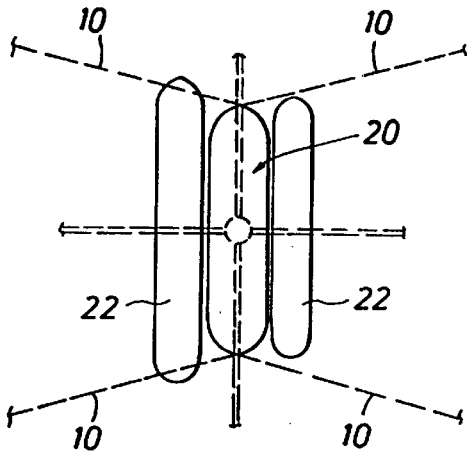
FIG. 1 (PRIOR ART)
FIGS. 1 and 2 show a prior art spread mooring system where the vessel may be skewed with respect to a nominal heading by shortening and lengthening anchor legs at the bow and stern of the vessel.
Figure 2:
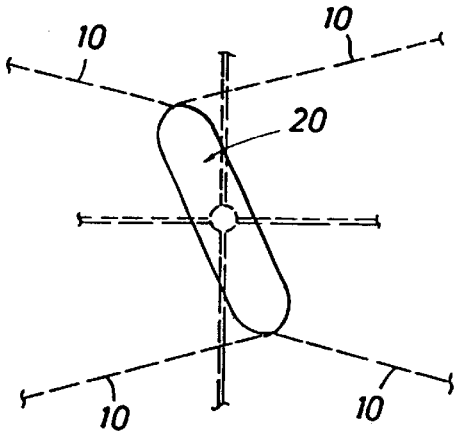
FIG. 2 (PRIOR ART)
Figure 3:
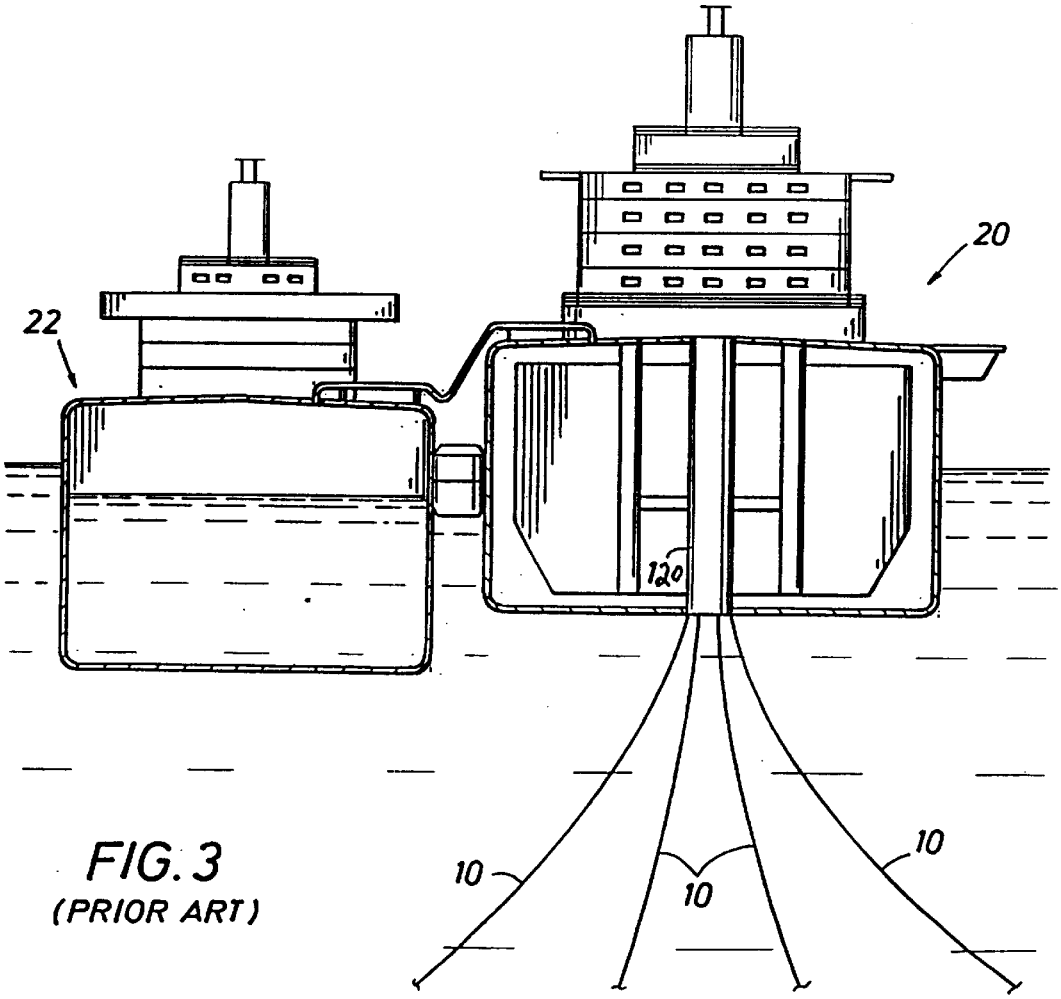
FIG. 3 (PRIOR ART)
FIGS. 3, 4 and 5 show a permanently moored prior art spread mooring system with anchor leg insert tubes at the bow and stern of the vessel.
Figure 4:
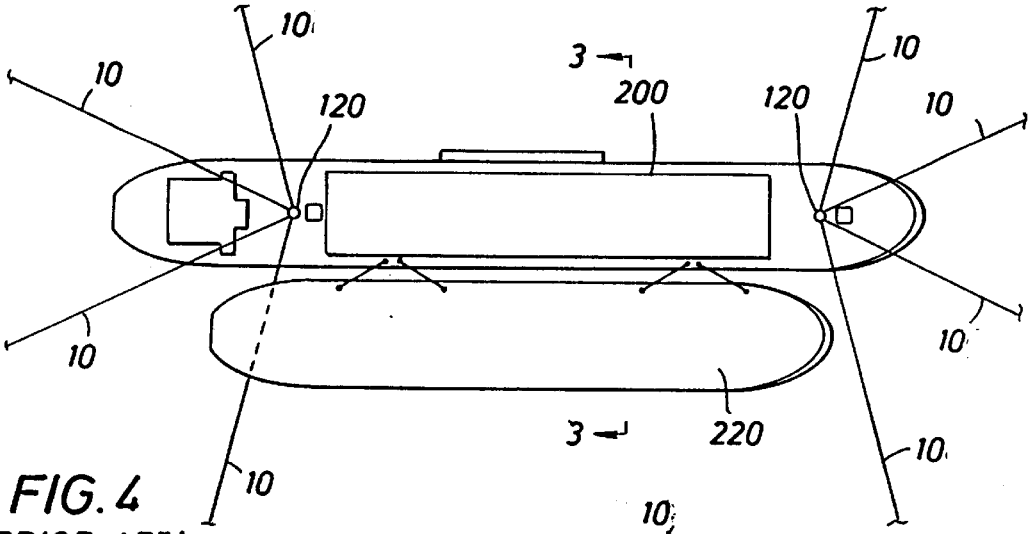
FIG. 4 (PRIOR ART)
Figure 5:
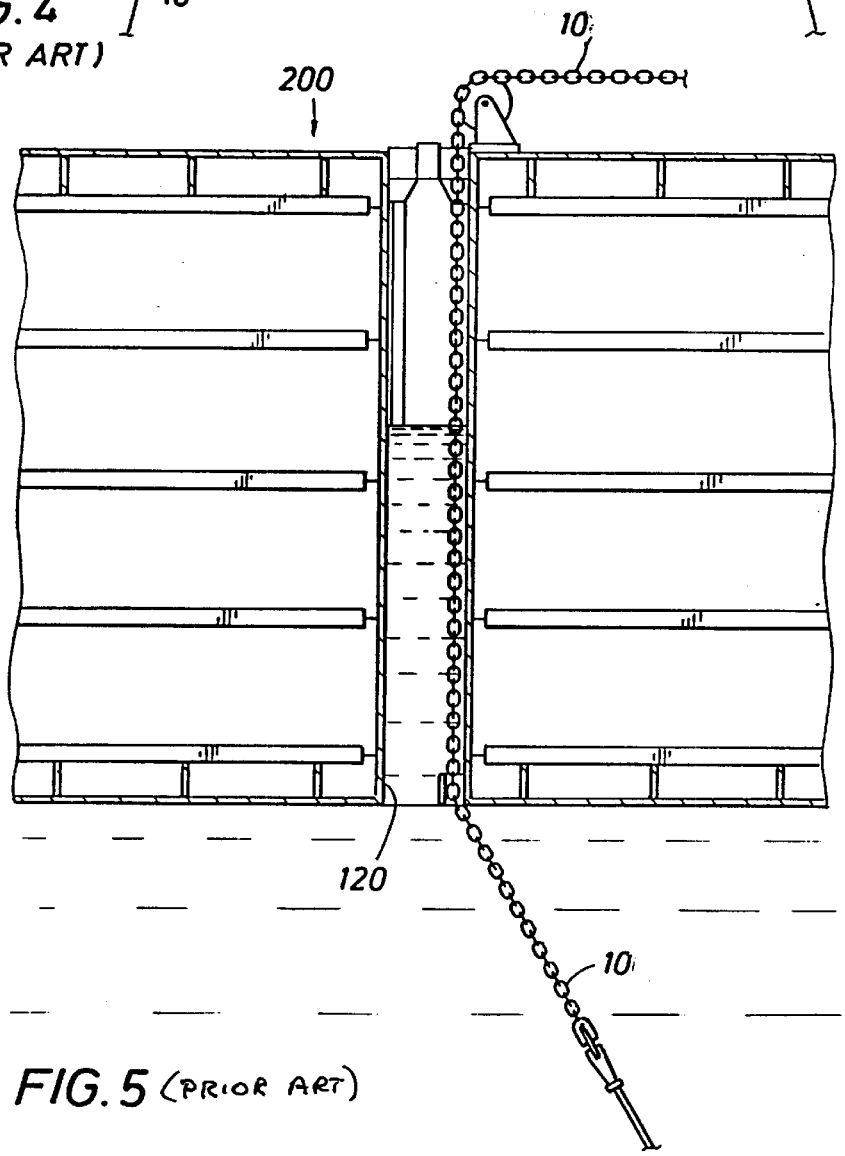
FIG. 5 (PRIOR ART)
Figure 6:
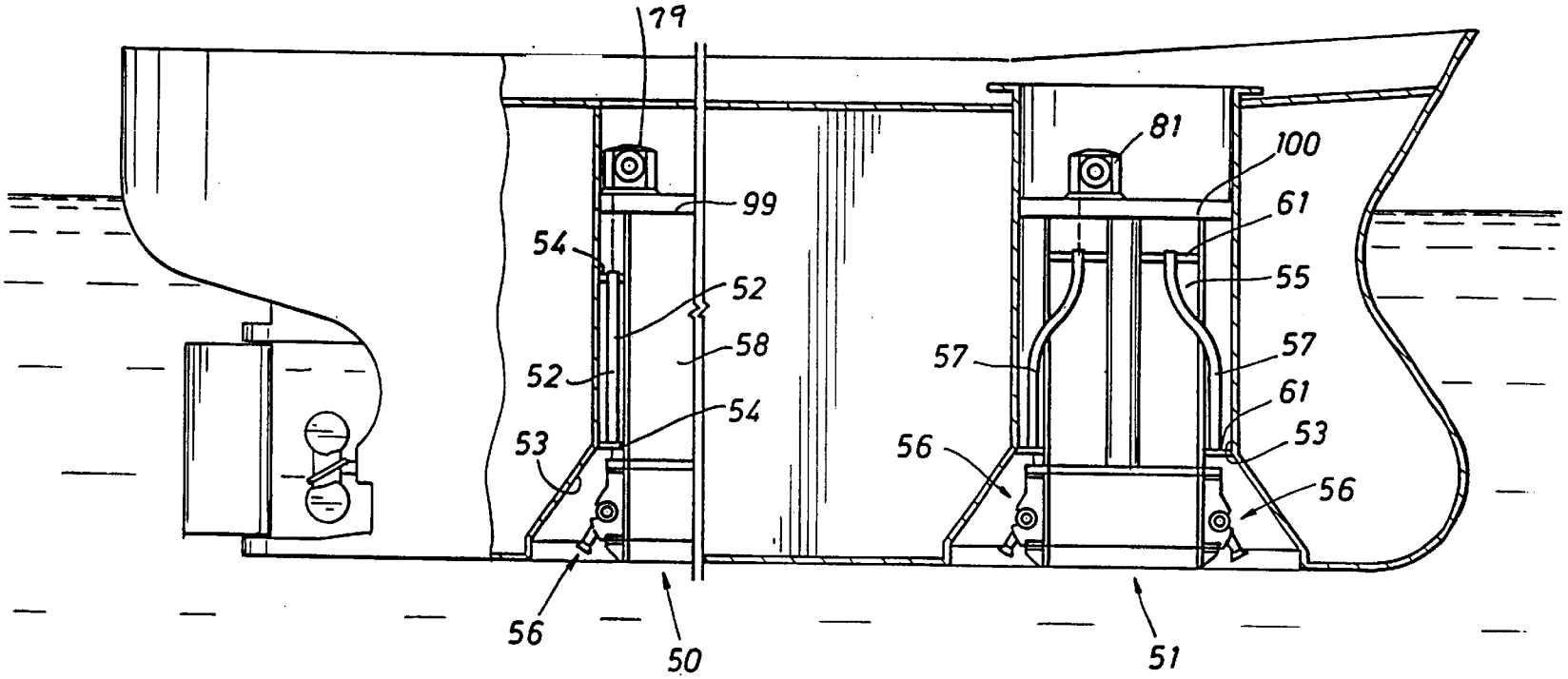
FIG. 6 is a partial side cross-section view of the vessel illustrating stern and bow insert tubes and showing swivel mounted chain supports according to the invention.
Figure 7:
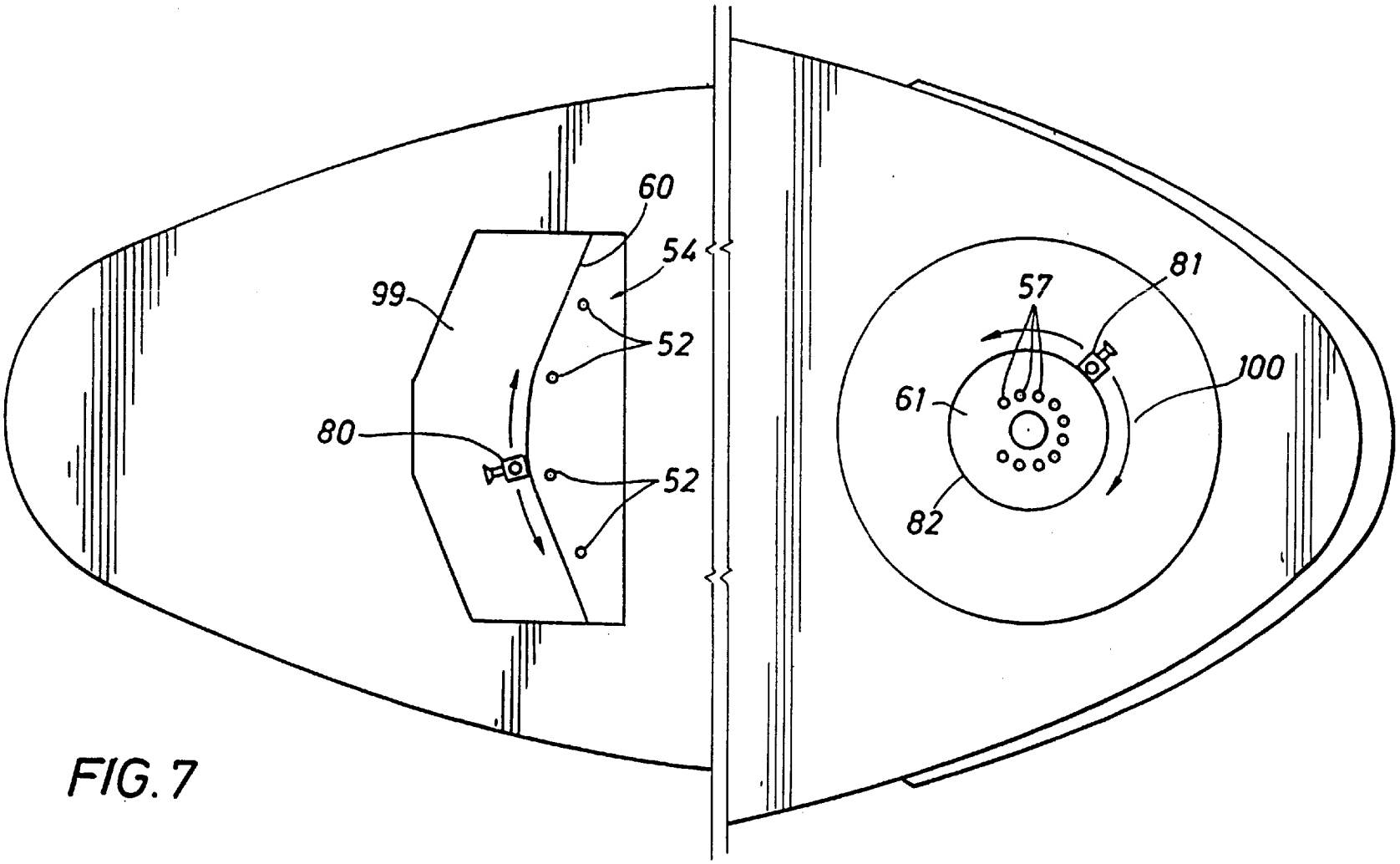
FIG. 7 is a partial top view of the vessel of FIG. 6 showing the stern and bow anchor leg orientations.

The mooring arrangement of FIGS. 6 and 7 is a variant of the prior art double point mooring arrangement of FIGS. 3, 4, and 5 but with the improvement of swiveling chain supports 56 which allow partial rotation or "skewing" of the vessel as in the prior art arrangement of FIGS. 1 and 2. Unlike the arrangement of prior art FIGS. 1 and 2, the improved arrangement of FIGS. 6 and 7 are not routed over and down the sides of the vessel, but are centrally located in a moonpool area 53 in which the insert tubes are defined.

As illustrated in FIGS. 6 and 7, a stern insert tube assembly 50 or 51 is arranged and designed to be manufactured as a unit and installed in a moonpool 53 at the stern of a FPSO or other offshore vessel. The assembly 50 includes a frame 58 and a plurality of insert tubes 52 mounted on frame 58, for example four such tubes are evident in the plan view of the stern as shown in FIG. 7. Such tubes are placed in an arc about the outer periphery of frame 58 so as to provide a spread array of anchor chains at the stern of the vessel. Each tube 52 has upper and lower supports 54 from frame 58 to provide vertical passage of an anchor chain from a swivel mounted chain support 56 mounted at the bottom of the frame 51. A single powered winch 79 is mounted on a deck 99 of the vessel. The deck 99 is positioned above the assembly 50. The winch 79 is movable on a track 60 such that a pull-in line of the winch 79 can be placed in alignment with any one of the tubes 52 of the stern insert assembly 50. During mooring operations, the installation winch 79 is moved from one insert tube 52 to another along track 60 so that its pull-in cable is aligned with the chain leg in any one of the insert tubes 52 without additional sheaves, etc. The swivel mounted chain support 56 swivels to directly face an anchor chain as it extends into the sea toward its end anchored in the seabed below.

Also illustrated in FIGS. 6 and 7 is a bow insert tube assembly 51 which, like the stern insert assembly 50, is an assembly which can be prefabricated and mounted within a moonpool 53 in the bow of the vessel. A plurality of bow insert tubes 57 are mounted on a frame 55 of the assembly 51. Each bow insert tube is supported by upper and lower supports 61. Aligned with each bow tube 57 is a dedicated swivel mounted chain support 56, one for each tube 57. A single installation winch 81 is mounted on a deck 100 of said vessel, where the deck 100 is positioned above the top of the assembly 51. The winch 81 can move on a track 82 so that its pull-in line is in alignment with the top ends of insert tubes 57.

The swiveling chain supports 56 can be located both above and below the keel level. Above keel level placement allows the entire steel insert tube assembly 50 and 51 support structures to be installed from above into the moon pool 53 with minimum drydock requirements. Below keel level installation allows reduction of the diameter, or size, of the moonpool 53, but requires more drydock time. Depending on the vessel configuration and overall scheduling, the combination of a swivel mounted chain support 56 with plural mooring insert tubes 52, 57 is flexible enough to adapt to the most desirable solution. The amount of deck machinery, both in number and cost, for installation of the anchor legs is significantly reduced due to a centralized location of a winch 79 or 81 on decks 99 or 100 above the assemblies 50 or 51. A single winch 79 or 81 one for the bow, the other for the stern, is all that is needed in lieu of multiple winches or a single winch with multiple overboarding fairleads, and several auxiliary sheaves required for the prior art arrangement of FIGS. 1 and 2.

FIGS. 8A, 8B and 8C illustrate in side, front and top views the swiveling chain supports 56 of FIG. 6. A trunnion support 40 is mounted by means of upper and lower swivel bearings 44, 42 so that the trunnion support 40 can rotate about a vertical axis 46 of the support frames 50 or 51. As a result, the trunnion support 40 can rotate from side to side about axis 46 to directly face an anchor chain which passes through it. The support 40 includes a hollow upper shaft 47 through which an anchor chain can pass so as to be in alignment with a mooring insert tubes 52 or 57 as shown in FIG. 6.

Bearing blocks 37 are provided between trunnions 35 and trunnion support 40. A trunnion style chain stopper 82 is installed in the housing 80. A chain tube 84 carried by housing 80 provides an entry path for a chain through the chain stopper 82 and through the hollow shaft 47 at the upper end of the trunnion support.

As illustrated in FIGS. 8A, 8B and 8C, this trunnion style chain stopper 82 is mounted into a trunnion housing 40 which itself rotates about an axis 46 perpendicular to that of the trunnion rotation axis 45. This arrangement, when used in a spread mooring system, can accommodate large vessel yaw rotations of up to +/−90 degrees, as illustrated in FIG. 2, from its nominal calm water heading. This arrangement is particularly applicable to a special type of spread mooring system which can partially weathervane. The advantage of integrating a trunnion chain stopper 82 into a swiveling housing 40 is that an anchor chain passing through it does not develop inter-link wear due to rotation of the individual links against one another. By locating the chain stopper 82 between the bearings 42, 44 of swivel housing 40, excessive loading on the swivel housing 40 due to chain twisting during vessel rotation is eliminated. The arrangement of FIGS. 8A, 8B, 8C advantageously eliminates prior combinations of a fairlead sheave with a separate chain stopper.

Figure 9:
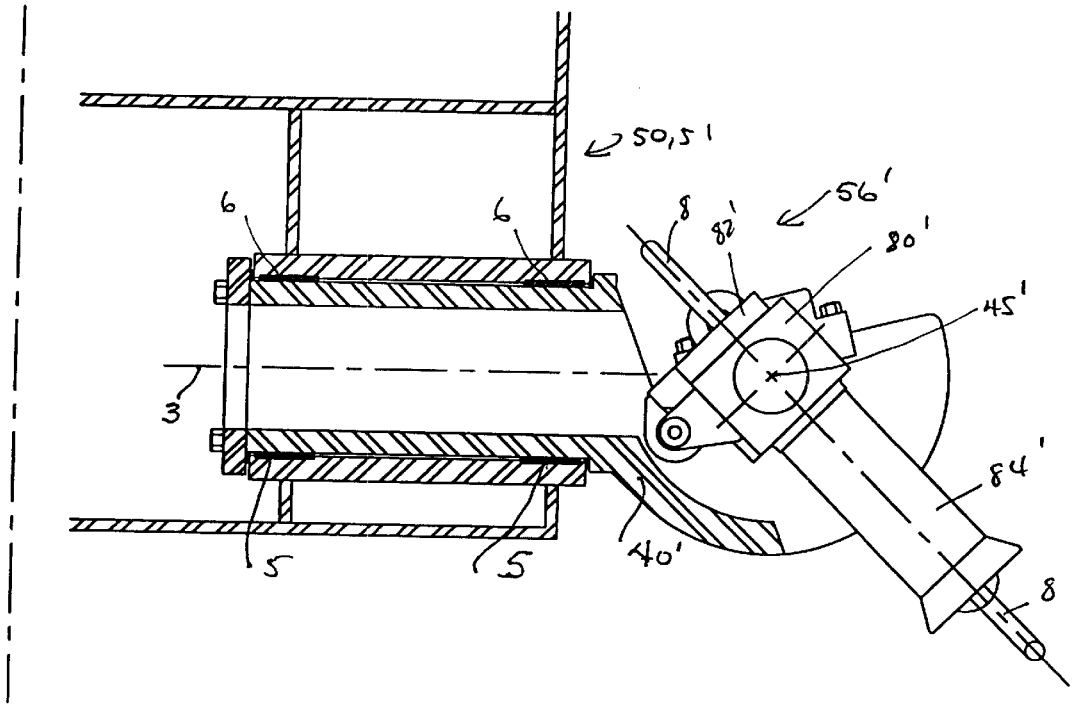
FIG. 9 illustrates an alternative trunnion chain stopper to that shown in FIGS. 8A, 8B, 8C, for partial rotation about a first horizontal axis and partial rotation about a second horizontal axis.

FIG. 9 illustrates a side view (partially in section) of an alternative embodiment of the chain support of FIGS. 8A, 8B, 8C. A chain support 56' is rotatably supported on support frames 50 or 51 with a trunnion support body 40' horizontally mounted via bearings 5, 6 such that the body 40' is free to rotate about a first horizontal axis 3. A trunnion chain stopper housing 80' is rotatably mounted on body 40' such that it is free for limited angular rotation about a second horizontal axis 45'. A chain stopper 82', is installed within chain stopper housing 80'. A chain tube 84' is coupled to the inlet of the chain stopper 82'. A chain 8 is illustrated as entering the chain tube 84' and exiting the chain stopper 82'.

What is claimed is:

1. In a vessel including a vertical passage which extends from a hull to a top deck including a plurality of anchor chains extending through said vertical passage, said vertical passage having a generally vertical axis, an improvement comprising, a structure (50) (51) arranged and designed to be installed and supported within said vertical passage (53), said structure (50) (51) including a support frame (58) (55) and a plurality of tubes (52) (57) placed in a tube arrangement about an outside periphery of said support frame, said tubes being arranged and designed for anchor chains to pass through, said tubes having top ends which are generally parallel to said vertical axis of said vertical passage.

2. The vessel of claim 1 further comprising, a deck (99) (100) mounted on said vessel above an upper end of said support frame (51) (55), a track (60) (82) disposed on said deck, said track placed in a track arrangement which corresponds to said tube arrangement, and a winch (79) (81) mounted on said deck and arranged and designed to move along said track (60) (82) so that a pull-in line can be generally registered with any of said top ends of said tubes (52) (57), whereby a single winch (79) (81) can pull in any one of a plurality of anchor chains disposed in said tubes (52) (57).

3. The vessel of claim 1 further comprising, a plurality of chain supports (56), each chain support (56) being rotationally mounted on said support frame (51) (55), each chain support having a chain outlet (47) which is in registration with one of said plurality of tubes, with each chain support having an inlet (84).

4. The vessel of claim 3 wherein each chain support (56) includes, a trunnion support body (40) arranged and designed for rotation about a support body vertical axis, said support body having a hollow upper shaft (47) serving as said chain outlet, said support body vertical axis being parallel to said vertical axis of said vertical passage, bearing blocks (37) mounted transversely to said vertical axis in said support body, a trunnion chain stopper housing (80) carried by said bearing blocks (37) and arranged and designed for rotation with respect to said support body (40) about an axis transverse to said vertical axis, a chain stopper (82) carried within said housing (80), said chain stopper having an outlet which communicates with said hollow upper shaft (47) for the passage of a chain, said chain stopper having an inlet, and a chain tube (84) coupled to said inlet of said chain stopper housing (80).

5. The vessel of claim 1 wherein said structure (50) is mounted in said vertical passage located at a stem of the vessel.

6. The vessel of claim 1 wherein said structure (51) is mounted in said vertical passage located at a bow of the vessel.

7. A chain support for a vessel comprising a trunnion support body arranged and designed for rotation about a first axis utilizing at least one swivel bearing, bearing blocks mounted transversely to said first axis in said support body, a trunnion chain stopper housing carried by said bearing blocks and arranged and designed for rotation with respect to said support body about a second axis which is transverse to said first axis, a chain stopper carried within said chain stopper housing, said chain stopper having an outlet for the passage of a chain, said chain stopper having an inlet, said chain passing through a bore within said at least one swivel bearing and a chain tube coupled to said inlet of said chain stopper housing.

8. The chain support of claim 7 wherein said first axis is a vertical axis and said second axis is a horizontal axis.

9. The chain support of claim 8 wherein said support body has a hollow upper shaft, and said outlet of said chain stopper communicates with said hollow upper shaft for the passage of a chain.

10. A chain support for a a vessel comprising a trunnion support body arranged and designed for rotation about a first horizontal axis, bearing blocks mounted transversely to said first horizontal axis in said support body, a trunnion chain stopper housing carried by said bearing blocks and arranged and designed for rotation with respect to said support body about a second horizontal axis which is transverse to said first axis, a chain stopper carried within said chain stopper housing, said chain stopper having an outlet for the passage of a chain, said chain stopper having an inlet, and a chain tube coupled to said inlet of said chain stopper housing.

* * * * *